US011660631B2

(12) United States Patent
Jan

(10) Patent No.: US 11,660,631 B2
(45) Date of Patent: May 30, 2023

(54) GLUE APPLYING MECHANISM OF EDGE BANDING MACHINE WITH GLUE QUANTITY REGULATOR

(71) Applicant: OAV EQUIPMENT AND TOOLS, INC., Taichung (TW)

(72) Inventor: Long-Chang Jan, Taichung (TW)

(73) Assignee: OAV EQUIPMENT AND TOOLS, INC., Taichung (TW)

( * ) Notice: Subject to any disclaimer, the term of this patent is extended or adjusted under 35 U.S.C. 154(b) by 0 days.

(21) Appl. No.: 17/308,229

(22) Filed: May 5, 2021

(65) Prior Publication Data

US 2022/0355332 A1 Nov. 10, 2022

(51) Int. Cl.
*B05C 5/02* (2006.01)

(52) U.S. Cl.
CPC ..... *B05C 5/0225* (2013.01); *B05C 5/0241* (2013.01)

(58) Field of Classification Search
None
See application file for complete search history.

(56) References Cited

U.S. PATENT DOCUMENTS 3,239,402 A * 3/1966 Ecklund ..... B21D 51/2676 156/200
3,405,022 A * 10/1968 Donlin ..... B27D 5/003 156/304.6
3,590,754 A * 7/1971 Jakobsen ..... A47B 13/083 52/800.11
3,649,417 A * 3/1972 Izen et al. ..... B27D 5/003 156/212
3,676,272 A * 7/1972 White et al. ..... B27D 5/003 156/574
3,753,832 A * 8/1973 Veneziale, Jr. ..... B05B 12/24 156/499
4,029,935 A * 6/1977 Archer ..... B29C 66/8181 156/577
4,222,812 A * 9/1980 Duewel ..... B29C 63/003 156/499
4,394,408 A * 7/1983 Walter ..... B05C 3/20 427/232
4,409,060 A * 10/1983 Janssens ..... B29C 63/0026 156/499
5,112,439 A * 5/1992 Reisman ..... H01L 21/30655 257/E21.171

(Continued)

*Primary Examiner* — Jethro M. Pence
(74) *Attorney, Agent, or Firm* — Muncy, Geissler, Olds & Lowe, P.C.

(57) ABSTRACT

A glue applying mechanism of an edge banding machine includes a base, a glue applying unit and a glue quantity regulator. The base includes a glue tub. The glue applying unit is rotatably disposed on the glue tub of the base and includes a glue shaft and an obliquely glue applying member connected with the glue shaft. The glue quantity regulator is rotatably disposed on the base and includes a rotatable shaft, and a regulating plate and a blocking plate, which are connected with the rotatable shaft. The regulating plate is rotatable along with the rotatable shaft to cause edges of the regulating plate adjacent to the glue applying unit at the same time. The blocking plate is fixed to the rotatable shaft separately from the regulating plate. The above-described configuration of the glue applying mechanism is effective in controlling the applied glue quantity in thickness.

6 Claims, 7 Drawing Sheets

(56) References Cited

U.S. PATENT DOCUMENTS 5,370,319 A * 12/1994 Schlegel ..... B05C 5/001 239/582.1
5,660,678 A * 8/1997 Parker, Jr. ..... B65H 35/02 156/577
5,996,659 A * 12/1999 Burgess ..... B27G 13/14 144/92
6,063,475 A * 5/2000 Ciancio ..... B32B 27/06 428/212
6,263,938 B1 * 7/2001 Maioli ..... B27D 5/003 156/468
6,336,702 B1 * 1/2002 Zapata ..... B41J 11/42 347/41
6,447,566 B1 * 9/2002 Rivera ..... B01D 46/121 55/497
6,467,522 B1 * 10/2002 Durney ..... B27D 5/003 156/355
7,189,442 B1 * 3/2007 Jesse ..... B32B 21/08 52/390
9,662,831 B1 * 5/2017 Lin ..... B29C 63/0026
10,124,536 B1 * 11/2018 Jan ..... B29C 65/78
10,479,027 B1 * 11/2019 Chang ..... B26D 1/24
10,954,412 B1 * 3/2021 Picker ..... C09J 7/243
2002/0152957 A1 * 10/2002 Pedigrew ..... B05C 5/0204 118/410
2003/0049371 A1 * 3/2003 Fort ..... B65B 51/023 427/207.1
2003/0054110 A1 * 3/2003 Yamaguchi ..... B05C 5/005 427/420
2003/0070615 A1 * 4/2003 Cottier ..... E04F 15/12 118/300
2003/0077390 A1 * 4/2003 Potyrailo ..... B82Y 30/00 506/40
2003/0170379 A1 * 9/2003 Tsujii ..... C03C 17/001 427/8
2003/0180453 A1 * 9/2003 Burke ..... B05C 11/1015 239/104
2004/0065066 A1 * 4/2004 Mertz ..... B01D 46/521 55/497
2007/0006970 A1 * 1/2007 Such ..... B27D 5/006 156/324
2007/0029031 A1 * 2/2007 Sgroi ..... B65H 81/08 156/425
2009/0280321 A1 * 11/2009 Empting, Jr. ..... C09J 7/24 428/339
2010/0004399 A1 * 1/2010 Empting, Jr. ..... C08L 23/0853 525/221
2011/0226410 A1 * 9/2011 Empting, Jr. ..... C09J 7/29 156/244.11
2012/0019490 A1 * 1/2012 Huang ..... G09G 3/32 345/83
2012/0058279 A1 * 3/2012 Schmid ..... B27D 5/003 427/337
2012/0186515 A1 * 7/2012 Lin ..... B27D 5/003 118/244
2012/0240846 A1 * 9/2012 Lin ..... B05C 11/041 118/244
2014/0205779 A1 * 7/2014 Lin ..... A47B 96/201 428/34.1
2015/0064414 A1 * 3/2015 Empting, Jr. ..... B32B 3/08 156/244.11
2016/0107281 A1 * 4/2016 Rathgeber ..... B27M 1/08 198/345.1
2018/0022489 A1 * 1/2018 Tanner ..... B65B 13/187 53/399
2019/0017702 A1 * 1/2019 Van Oeveren ..... B29C 65/106
2020/0384495 A1 * 12/2020 Chang ..... B05C 1/006

* cited by examiner

GLUE APPLYING MECHANISM OF EDGE BANDING MACHINE WITH GLUE QUANTITY REGULATOR

BACKGROUND OF THE INVENTION

1. Field of the Invention

The present invention relates to a glue applying mechanism of an edge banding machine and more particularly, to a glue applying mechanism of an edge banding machine with a glue quantity regulator.

2. Description of the Related Art

The traditional edge banding machine is adapted to apply glue to a workpiece to be processed, and attach an edge band to the workpiece applied with the glue. The surface of the workpiece can be protected by the edge band and attain an embellished effect.

However, for different specifications of workpieces and different types of glue, the glue quantity required to apply sometimes needs to be adjusted in thickness. Therefore, for the edge banding process to be accomplished well, it requires a glue applying mechanism capable of adjusting the glue quantity to adapted for different specifications of workpieces and different types of glue.

SUMMARY OF THE INVENTION

It is one of the objectives of the present invention to make an improvement for the deficiencies of the conventional edge banding machine, so as to provide a new glue applying mechanism of an edge banding machine, which can effectively regulate glue quantity.

Therefore, the present invention provides a glue applying mechanism of an edge banding machine with a glue quantity regulator, which includes a base, a glue applying unit and a glue quantity regulator. The base includes a glue tub, and the glue tub is adapted for accommodating glue. The glue applying unit is rotatably disposed on the glue tub of the base and includes a glue shaft and an obliquely glue applying member. The aforementioned obliquely glue applying member is coaxially connected to the top of the glue shaft. The obliquely glue applying member has a glue applying surface. The glue applying surface is a tapered surface with a wide top and a narrow bottom. At least a part of the top of the aforementioned glue shaft and the glue applying surface of the obliquely glue applying member are exposed outside the glue tub. The glue applying unit is able to be driven to rotate to extract the glue in the glue tub to an outer surface of the glue shaft and the glue applying surface of the obliquely glue applying member. The aforementioned glue quantity regulator is rotatably disposed on the base. The glue quantity regulator includes a rotatable shaft, a regulating plate and a blocking plate. The aforementioned regulating plate is fixed to the rotatable shaft and has a vertical edge and an oblique edge. The regulating plate is rotatable along with the rotatable shaft to cause the vertical edge and the oblique edge separately adjacent to the glue applying surface and the outer surface of the glue shaft at the same time. The blocking plate is fixed to the rotatable shaft separately from the regulating plate.

By the configuration of the aforementioned glue applying mechanism, when the applied glue quantity needs to be lowered, the operator can rotate the rotatable shaft to make the regulating plate as adjacent to the glue applying unit of the glue applying mechanism as possible. In contrary, when the applied glue quantity needs to be increased, the operator can rotate the rotatable shaft a little bit to increase the gap between the regulating plate and the glue applying unit, so that the glue quantity applied to the surface of the workpiece can be effectively adjusted in thickness by the operator according to the processing requirement.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

The technique and features of the present invention will be detailedly specified in the instanced embodiment given herein below and the accompanying drawings. The directional terms mentioned in this specification, such as 'above'. 'downward', 'inside', 'outside', 'top' and 'bottom', are just for illustrative description on the basis of normal usage direction, not intended to limit the claimed scope.

For the detailed description of the technical features of the present invention, an illustrative preferred embodiment and the accompanying drawings are given herein below.

Figure 1:
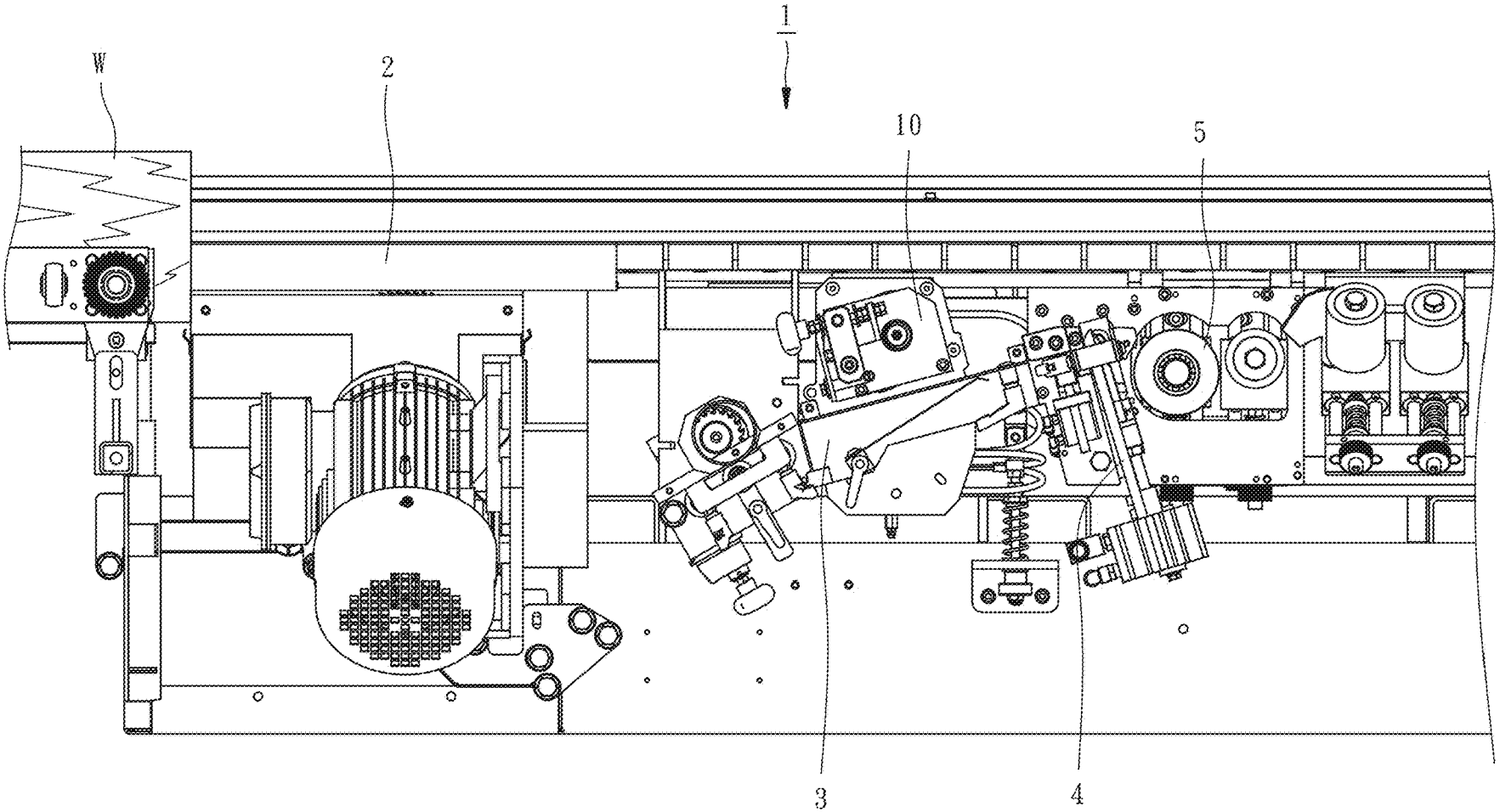
FIG. 1 is a partial top view of an edge banding machine of an embodiment.
Figure 7:
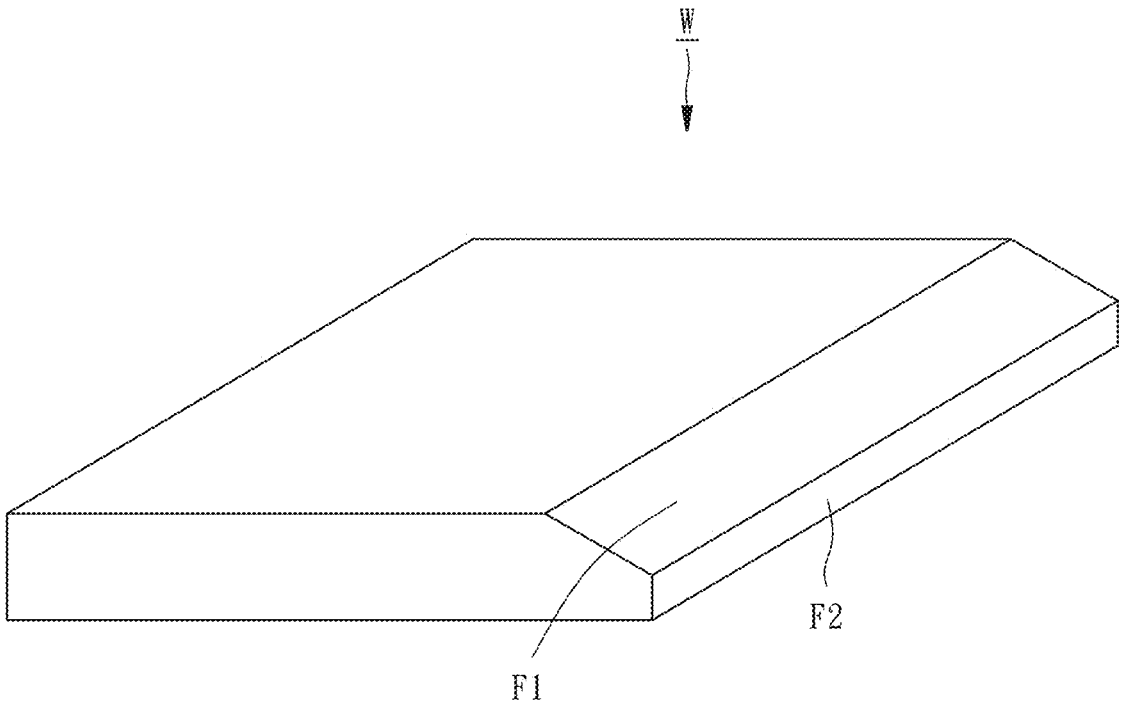
FIG. 7 is a perspective view of a workpiece.

This embodiment provides a glue applying mechanism 10 of an edge banding machine 1. As shown in FIG. 1, the edge banding machine 1 structurally includes a pre-milling mechanism 2, the aforementioned glue applying mechanism 10, an edge band conveying mechanism 3, a set of knives 4, and a horizontal pressing wheel set 5. The pre-milling mechanism 2 is adapted for trimming the surface of the workpiece W when the workpiece W is not applied with glue yet. The glue applying mechanism 10 is adapted for applying glue to an oblique surface F1 and a vertical surface F2 of the workpiece W after it is trimmed, as shown in FIG. 7. The edge band conveying mechanism 3 is adapted for conveying an edge band (not shown). The knife 4 is adapted for cutting off the edge band to a predetermined length, enabling the cut-off edge band to be tightly boned to the surface of the workpiece W when the glue-applied workpiece W passes through the horizontal pressing wheel set 5.

Figure 2:
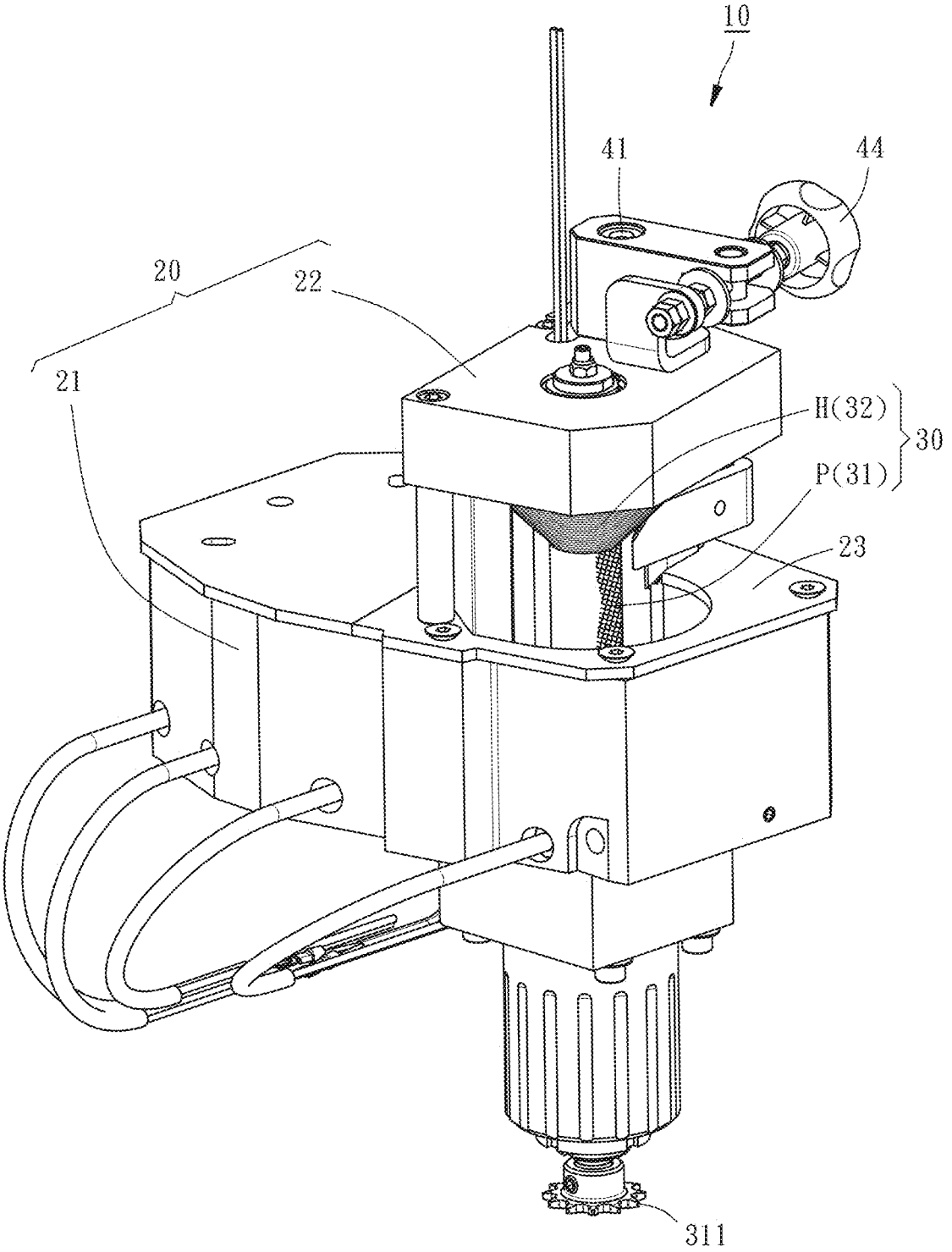
FIG. 2 is a perspective view of a glue applying mechanism of the edge banding machine of the embodiment.
Figure 3:
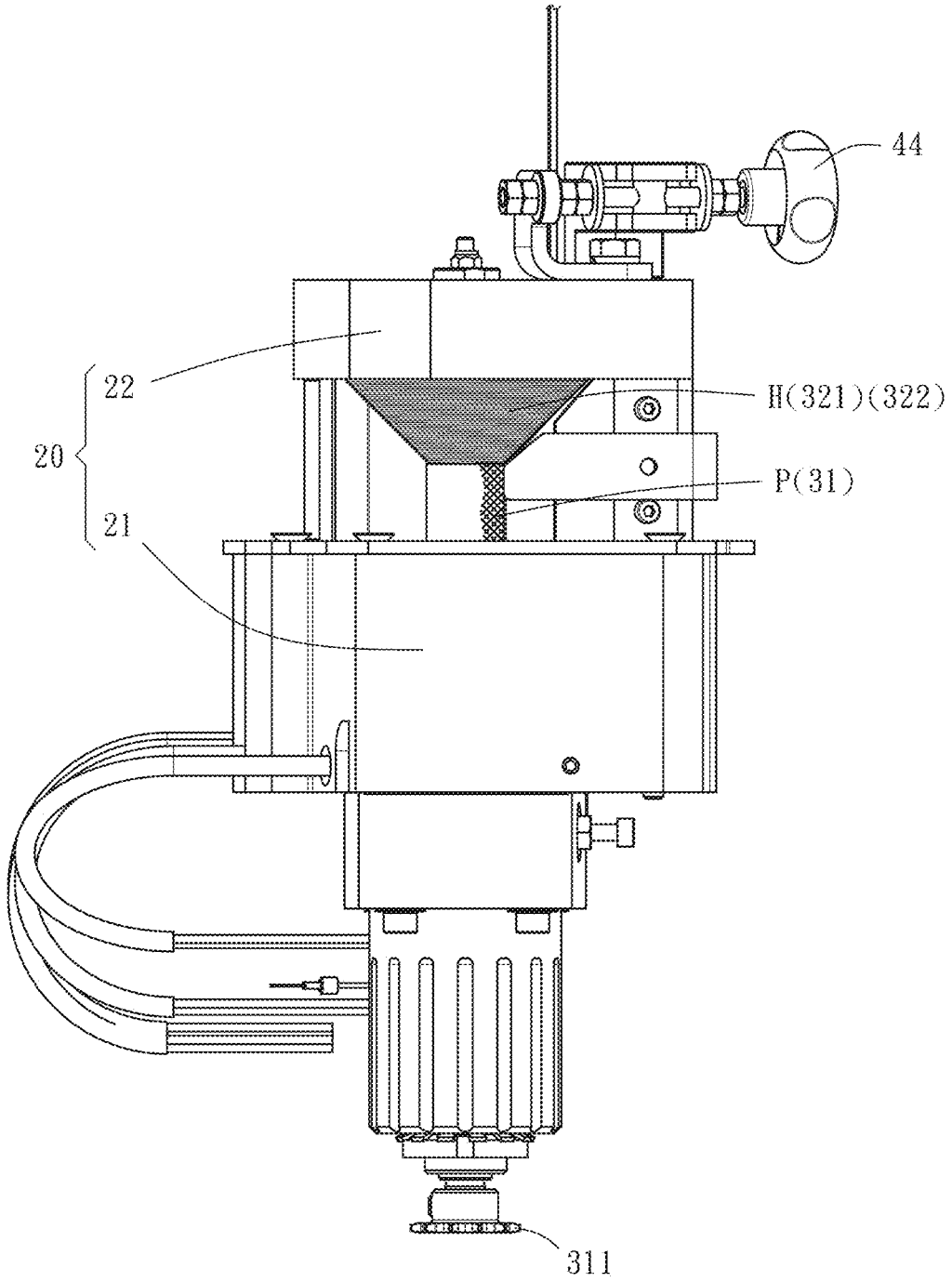
FIG. 3 is a lateral view of FIG. 2.
Figure 4:
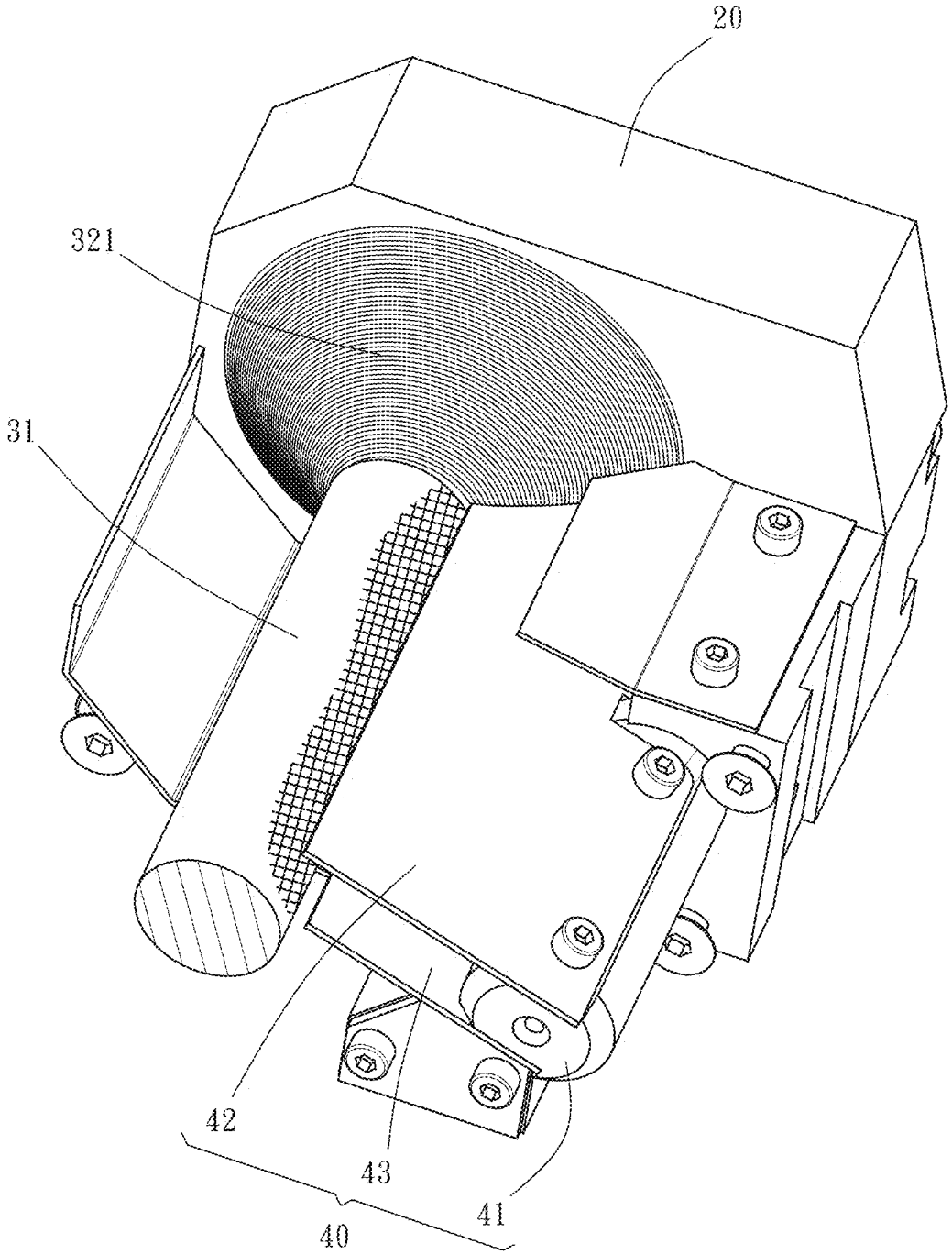
FIG. 4 is an enlarged perspective view of FIG. 2.
Figure 5:
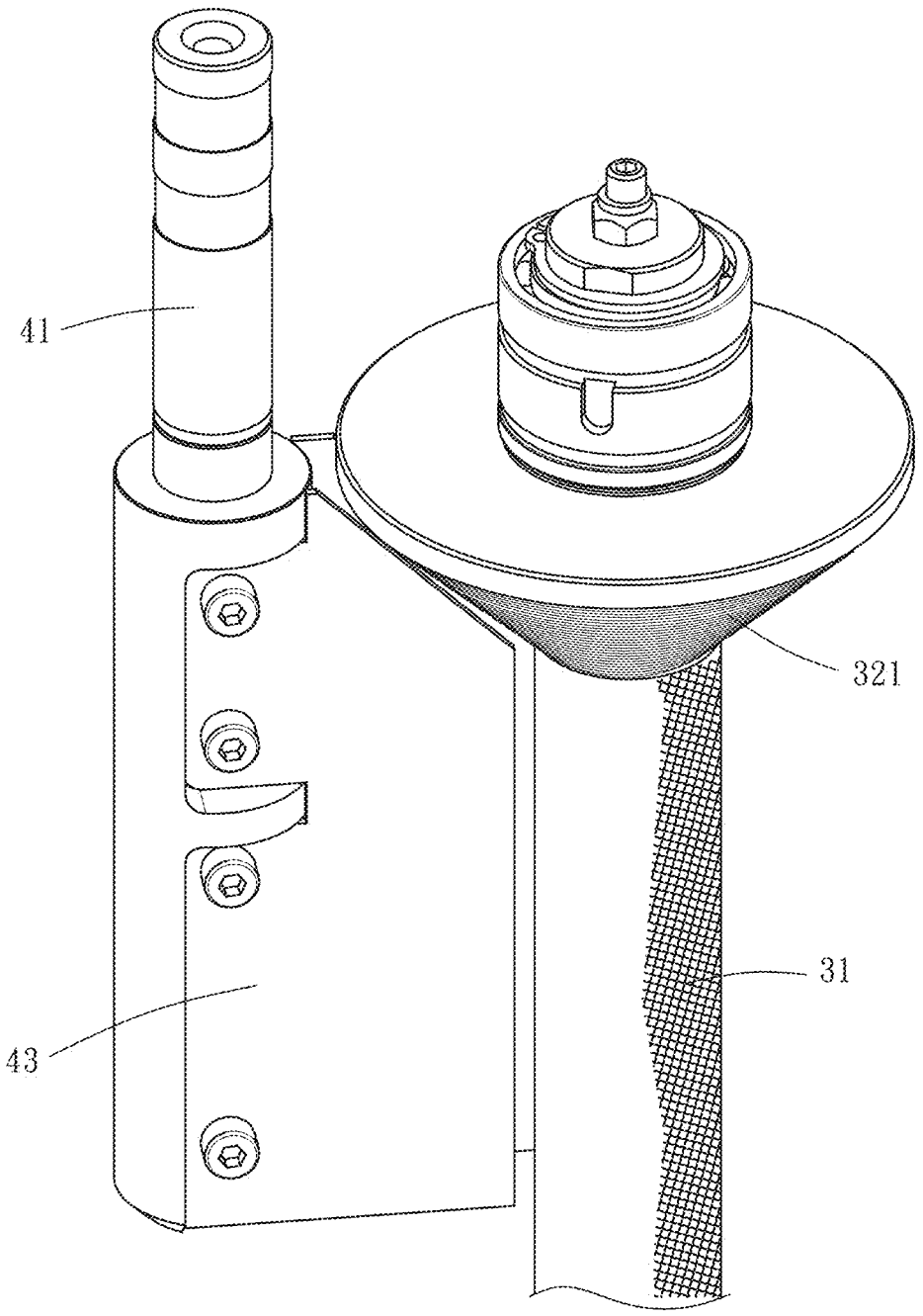
FIG. 5 is similar to FIG. 4, only partially showing a glue applying unit and a glue quantity regulator.
Figure 6:
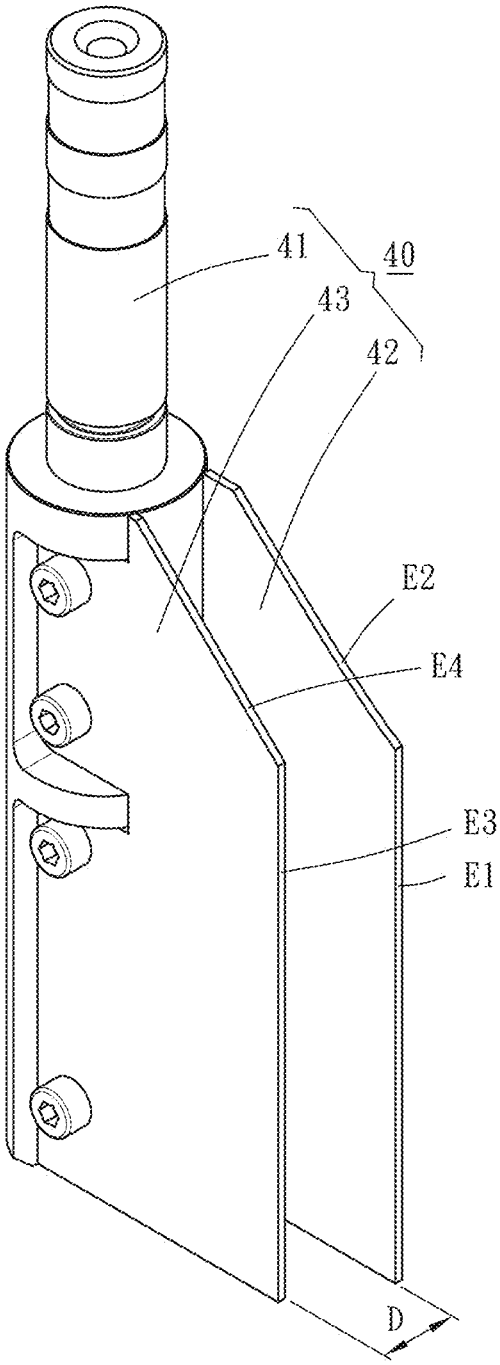
FIG. 6 is a perspective view of the glue quantity regulator of the embodiment.

As shown in FIG. 2 to FIG. 4, the glue applying mechanism 10 structurally includes a base 20, a glue applying unit 30 and a glue quantity regulator 40. The base 20 structurally includes a glue tub 21 and a fixed seat 22. The glue tub 21 is adapted for accommodating glue. The fixed seat 22 is located above the glue tub 21 and fixed above the glue tub 21 through a covering plate 23.

The glue applying unit 30 is rotatably disposed on the glue tub 21 of the base 20 and structurally includes a glue shaft 31 and an obliquely glue applying member 32. The glue shaft 31 is provided on the outer surface thereof with embossed structure P. The bottom end of the glue shaft 31 protrudes out of the glue tub 21, and the bottom end of the glue shaft 31 is connected with a chain wheel 311, enabling the edge banding machine 1 that the glue shaft 31 is driven to rotate through a motor and a chain (not shown), the technique of that can be referred to Taiwan Patent No. 1691365. The obliquely glue applying member 32 is coaxially connected to the top of the glue shaft 31. The obliquely glue applying member 32 has a glue applying surface 321. The glue applying surface 321 is a tapered surface with a wide top and a narrow bottom. The glue applying surface 321 in this embodiment is an inverted conical surface. The glue applying surface 321 is provided thereon with a concave and convex structure 322. In this embodiment, the concave and convex structure 322 is a cone-shaped spiral groove H.

Referring to FIG. 3 to FIG. 6, the glue quantity regulator 40 is rotatably disposed on the fixed seat 22 of the base 20. The glue quantity regulator 40 structurally includes a rotatable shaft 41, a regulating plate 42 and a blocking plate 43. The top end of the rotatable shaft 41 protrudes out of the fixed seat 22, and a handle 44 is connected above the rotatable shaft 41 for the operator to conveniently hold the handle 44 to rotate the rotatable shaft 41. The regulating plate 42 is made of metal sheet and fixed to the rotatable shaft 41. The regulating plate 42 is a plate uniform in thickness and has a vertical edge E1 and an oblique edge E2. The oblique edge E2 is directly connected with the vertical edge E1. The regulating plate 42 is configured correspondingly to the glue applying unit 30, enabling that when the operator rotates the rotatable shaft 41, the regulating plate 42 is rotated along with the rotatable shaft 41 to cause the vertical edge E1 and the oblique edge E2 separately adjacent to the outer surface of the glue shaft 31 and the glue applying surface 321 at the same time, which means the vertical edge E1 and the oblique edge E2 are not in contact with the outer surface of the glue shaft 31 and the glue applying surface 321. There is still a gap between the regulating plate 42 and the glue applying unit 30, and this gap is adapted to decide the thickness of the glue applied to the surface of the workpiece W. The blocking plate 43 is also made of metal sheet and is a plate uniform in thickness, which is fixed to the rotatable shaft 41 separately from the regulating plate 42. The blocking plate 43 is configured similarly to the regulating plate 42 and thereby also has a vertical edge E3 and an oblique edge E4. The vertical edge E3 of the blocking plate 43 is directly connected with the oblique edge E4 of the blocking plate 43. In this embodiment, the blocking plate 43 and the regulating plate 42 are arranged parallel to each other. The blocking plate 43 and the regulating plate 42 have a predetermined distance D therebetween. The width of the blocking plate 43 is smaller than the width of the regulating plate 42. In coordination with the viscosity coefficient of the glue and the rotational speed of the driven glue applying unit 30, the molten glue extracted from the glue tub 21 by the glue applying unit 30 will be blocked by the blocking plate 43, thereby uneasy to flow downward to the bottom of the glue tub 21 quickly and directly. That enables the glue applying unit 30 to extract the glue to the outer surface of the glue shaft 31 and the glue applying surface 321 of the obliquely glue applying member 32 well.

By the above-described configuration of the glue applying mechanism 10, when the applied glue quantity needs to be lowered, the operator can hold the handle 44 to rotate the rotatable shaft 41 to make the regulating plate 42 more adjacent to the glue applying unit 30 of the glue applying mechanism 10, so as to reduce the gap between the regulating plate 42 and the glue applying unit 30, thereby reducing the thickness of the applied glue, i.e. reducing the applied glue quantity. In contrary, when the thickness of the applied glue needs to be increased, the operator can rotate the rotatable shaft 41 to increase the gap between the regulating plate 42 and the glue applying unit 30, so that the operator can effectively adjust the glue quantity of the glue according to the processing requirement.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A glue applying mechanism of an edge banding machine, the glue applying mechanism comprising:

a base comprising a glue tub which is adapted for accommodating glue;

a glue applying unit rotatably disposed on the glue tub of the base and comprising a glue shaft and an obliquely glue applying member, the obliquely glue applying member being coaxially connected to a top of the glue shaft, the obliquely glue applying member having a glue applying surface which is a tapered surface with a wide top and a narrow bottom, at least a part of the top of the glue shaft and the glue applying surface of the obliquely glue applying member being exposed outside the glue tub, the glue applying unit being able to be driven to rotate to extract the glue in the glue tub to an outer surface of the glue shaft and the glue applying surface of the obliquely glue applying member; and a glue quantity regulator rotatably disposed on the base, the glue quantity regulator comprising a rotatable shaft, a regulating plate and a blocking plate, the regulating plate being fixed to the rotatable shaft and having a vertical edge and an oblique edge, the regulating plate being rotatable along with a rotation of the rotatable shaft, the blocking plate being fixed to the rotatable shaft separately from the regulating plate, wherein the oblique edge of the regulating plate is obliquely extended and separated from the glue applying surface and the vertical edge of the regulating plate is vertically extended and separated from the outer surface of the glue shaft, so that a gap is defined between the glue applying surface and the oblique edge, and between the outer surface of the glue shaft and the vertical edge.

2. The glue applying mechanism as claimed in claim 1, wherein the base further comprises a fixed seat; the fixed seat is fixed above the glue tub, and the glue quantity regulator is rotatably disposed on the fixed seat.

3. The glue applying mechanism as claimed in claim 1, wherein the oblique edge of the regulating plate is directly connected with the vertical edge.

4. The glue applying mechanism as claimed in claim 1, wherein the blocking plate is fixed to the rotatable shaft parallel to the regulating plate.

5. The glue applying mechanism as claimed in claim 1, wherein the blocking plate also has a vertical edge and an oblique edge; the vertical edge of the blocking plate is directly connected with the oblique edge of the blocking plate.

6. The glue applying mechanism as claimed in claim 1, wherein a width of the blocking plate is smaller than a width of the regulating plate.

* * * * *